US005342261A

United States Patent [19]

Johnston

[11] Patent Number: 5,342,261

[45] Date of Patent: Aug. 30, 1994

[54] ADJUSTABLE CYCLING APPARATUS

[76] Inventor: Gary Johnston, P.O. Box 183, Cowarts, Ala. 36321

[21] Appl. No.: 131,396

[22] Filed: Oct. 5, 1993

Related U.S. Application Data

[63] Continuation-in-part of Ser. No. 710,541, May 6, 1991, Pat. No. 5,292,294, and a continuation-in-part of Ser. No. 748,034, Aug. 2, 1991, abandoned.

[51] Int. Cl.[5] ..... A63B 23/05

[52] U.S. Cl. ..... 482/57; 482/51

[58] Field of Search ..... 482/51, 57, 60, 110, 482/63

[56] References Cited

U.S. PATENT DOCUMENTS 3,910,571 10/1975 Stenn ..... 482/60

3,968,963 7/1976 Sileo ..... 482/60

4,601,464 7/1986 Mousel ..... 482/57

*Primary Examiner*—Stephen R. Crow

*Attorney, Agent, or Firm*—Richard C. Litman

[57] ABSTRACT

An adjustable cycling apparatus including a pedal mechanism which may be adjusted to various horizontal and vertical positions for a more versatile cycling exercise routine. The cycling apparatus includes a frame unit, upon which the pedal mechanism is mounted. The pedal mechanism is collapsible into the frame unit for easy storage. The frame unit supports a seat with adjustable back and arm supports whereby cycling exercise routines may be performed from a comfortable seated position. The back and arm supports may also be lowered to add to the collapsibility of the apparatus.

9 Claims, 6 Drawing Sheets

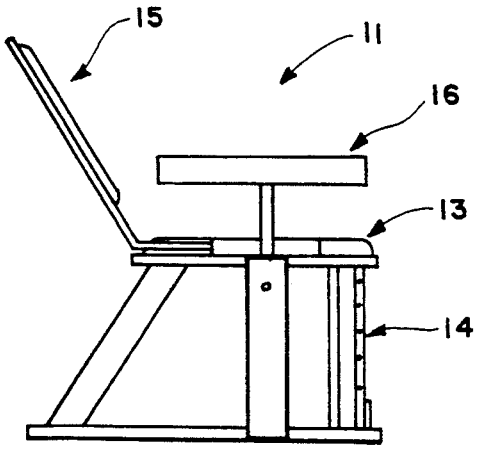
FIG. 2A
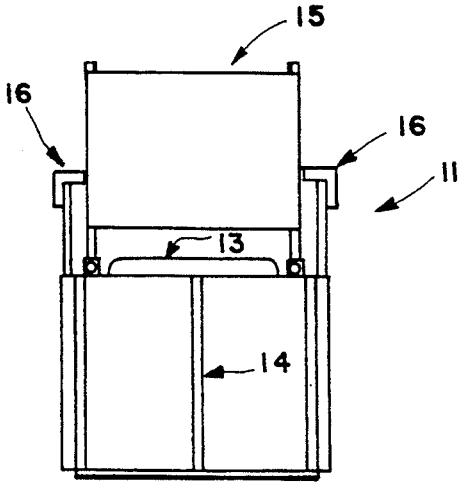
FIG. 2B
FIG. 2C
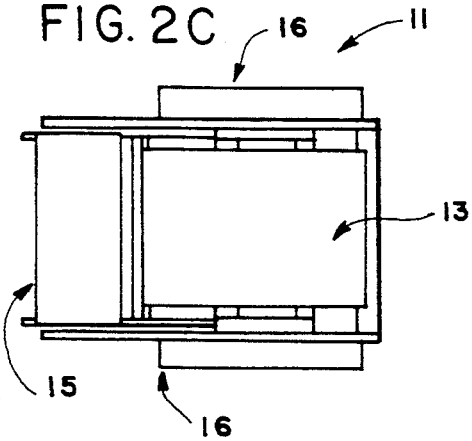
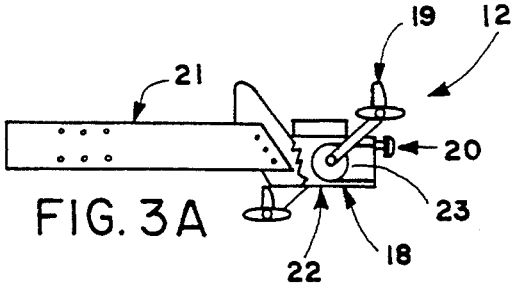
FIG. 3A
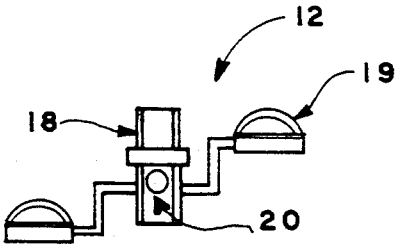
FIG. 3B
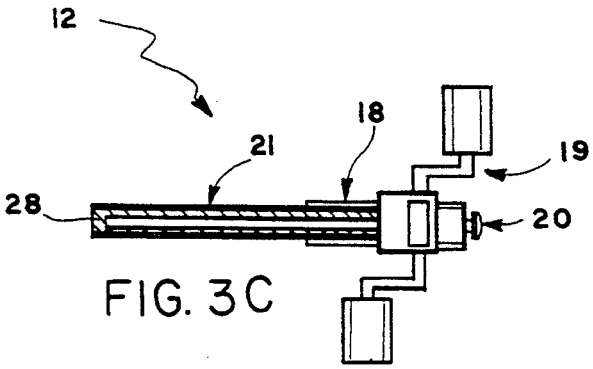
FIG. 3C

ADJUSTABLE CYCLING APPARATUS

CROSS-REFEREENCE TO RELATED APPLICATIONS

This application is a continuation-in-part of U.S. application Ser. Nos. 07/710,541, filed Jun. 5, 1991 now U.S. Pat. No. 5,292,294 and 07/748,034, filed Aug. 21 1991, now abandoned. Their disclosures are herein incorporated by reference.

BACKGROUND OF THE INVENTION

1. Field of the Invention

The present invention relates to an exercise device and more particularly to a cycling apparatus with a position adjustable pedaling mechanism.

2. Description of the Prior Art

Presently there exists many variations of home cycling devices designed specifically for indoor use. While these conventional devices offer a relatively effective means for providing cycling exercise, most are one dimensional, i.e. the pedal mechanism is always positioned at one location, with the pedaling mechanism usually located substantially below the user. Also, most of the cycling units presently available are not comfortable and hard to balance upon. Other cycling units which have the pedaling mechanism placed in front of the user are low to the ground, providing inadequate access for some people, such as those with physical disabilities. Cycling devices which offer some adjustability are known.

U.S. Pat. No. 3,057,201 to Jaeger discloses a cycling device with a pedal unit which can only be adjusted about a single pivot point.

U.S. Pat. No. 4,770,411 to Armstrong discloses a cycling device which has an adjustable seat and a fixed position pedal unit.

U.S. Pat. No. 4,838,547 to Sterling discloses a cycling apparatus with a pedal unit which can be pivotally adjusted and folded under the frame for storage.

None of the above inventions and patents, taken either singly or in combination, is seen to describe the instant invention as claimed.

SUMMARY OF THE INVENTION

The present invention is a cycling apparatus, intended for indoor use, which comprises a structural frame unit and a pedal mechanism assembly unit.

The structural frame unit comprises an adjustable seat, from which the user operates the device, mounted on a rigid frame and an assembly support for supporting and/or connecting the pedal mechanism assembly unit with the rigid frame.

The pedal mechanism assembly unit comprises a pedal assembly, resistance means, an assembly structure for supporting the pedal assembly and resistance means, and an attachment means for connecting the assembly unit with the assembly support of the structural frame unit. Optionally, an exercise data collection and display means, such as an exercise computer, may be attached.

The pedal mechanism assembly unit and the structural frame unit are slidably and pivotally coupled such that the pedal mechanism assembly unit can be positioned at various horizontal, vertical, and angled alignments with respect to the structural frame unit, then reversibly secured in place for the duration of a cycling routine.

Accordingly, it is a principal object of the invention to provide a cycling apparatus which is comfortable to operate and which allows the user to position a pedalling mechanism at various horizontal, vertical, and angled positions thereby allowing for a versatile exercise cycling routine.

It is another object of the invention to provide a cycling apparatus which is collapsible into a more compact configuration to facilitate storage and transport.

It is a further object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 2A is a side view of one embodiment of the structural frame unit of the apparatus shown in FIGS. 1A–1C.

FIG. 2B is a front view of the same.

FIG. 2C is a top view of the same.

FIG. 3A is a side partial cutout view of one embodiment of the pedal mechanism assembly unit of the apparatus shown in FIGS. 1A–1C.

FIG. 3B is a front view of the same.

FIG. 3C is a top view of the same.

Similar reference characters denote corresponding features consistently throughout the attached drawings.

DETAILED DESCRIPTION OF THE PREFERRED EMBODIMENTS

Figure 1A:
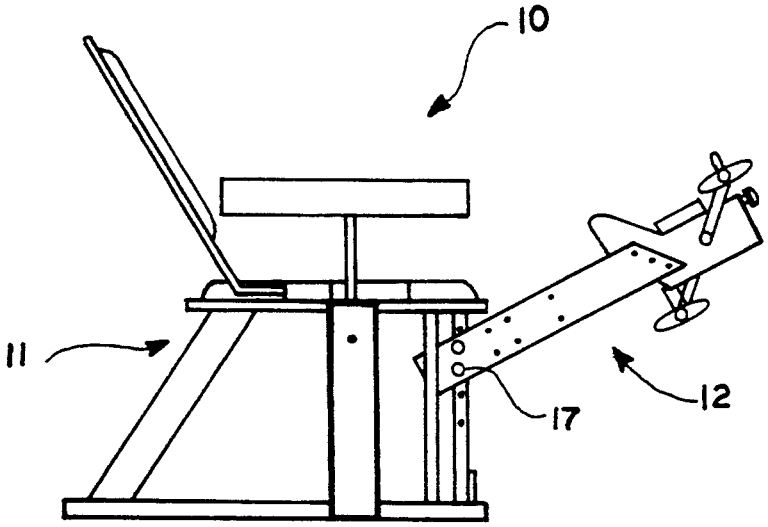
FIG. 1A, 1B, and 1C are side views of an embodiment of the present apparatus.
Figure 1B:
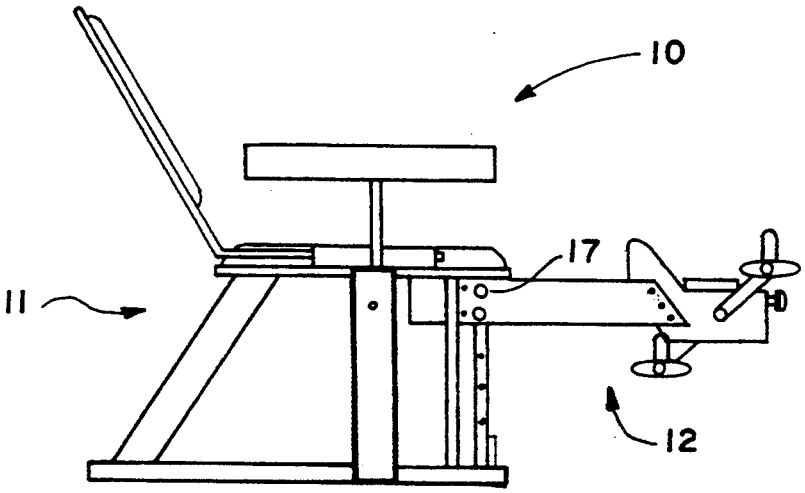
Figure 1C:
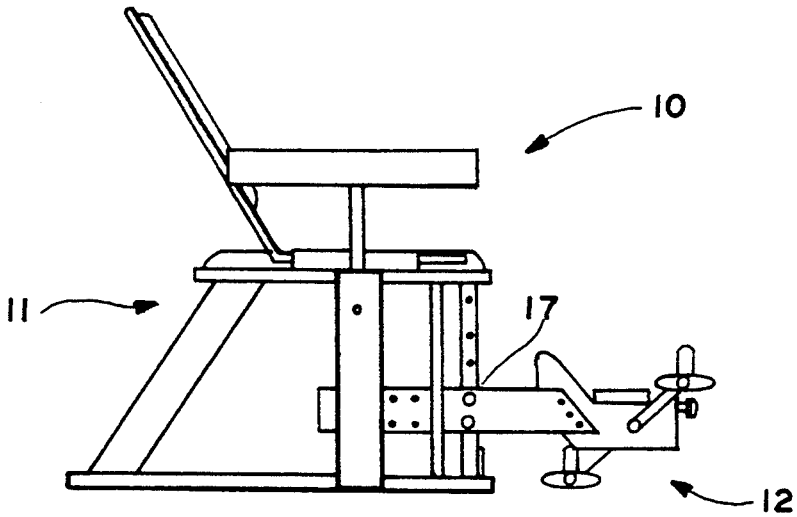

The present invention can best be seen by reference to the drawings, and in particular to FIGS. 1A–1C and 5A–5C. The cycling apparatus that forms the basis of the present invention is designated by the reference numeral 10. Cycling apparatus 10 comprises a structural frame unit 11 and a pedal mechanism assembly unit 12.

As shown in FIGS. 2A–2C and 6A–6C, the structural frame unit 11 comprises an adjustable seat, which includes seating means 13 from which the user operates the apparatus, a back support means 15, and an arm rest support means 16; a rigid frame; and an assembly support for supporting and/or connecting pedal mechanism assembly unit 12 to the rigid frame of the structural frame unit.

As shown in FIGS. 3A–3D and 7A–7C, the pedal mechanism assembly unit 12 comprises an assembly structure 18 for supporting a pedal assembly 19 and resistance means 20. Attachment means 21 is used to connect said assembly structure to the assembly support of structural frame unit 11.

Resistance means 20 may be of any type used in conventional cycling apparatus which increases the work necessary for a user to rotate the pedals of the pedal assembly in a cycling manner. Preferred resistance means are of the brake or flywheel type. FIG. 3A shows a pedal mechanism assembly unit employing a preferred embodiment of the break type resistance means. Therein the pedal assembly 19 comprises pedals and a hub to which said pedals are attached; and the resistance means 20 comprises a brake pad and tension adjustment means. Said hub comprises a drum member. Said pedals rotate drum member 23, which is in contact with brake pad 22. Said break pad may be tightened or loosened against said drum member by any conventional tension adjustment means to produce variable resistance to rotational motion of the pedal assembly.

Figure 7A:
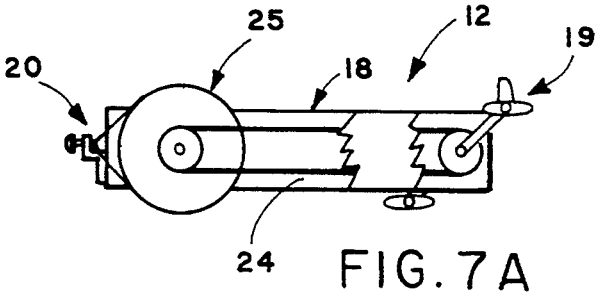
FIG. 7A is a partial cutout side view of one embodiment of the pedal mechanism assembly unit of the apparatus shown in FIGS. 5A–5C.
Figure 7B:
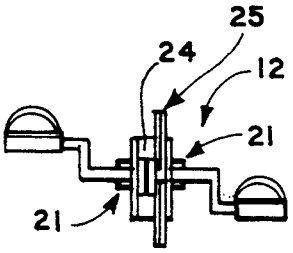
FIG. 7B is a front view of the same.
Figure 7C:
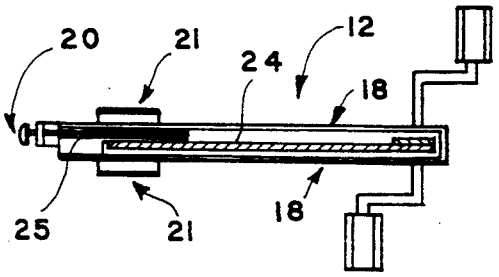
FIG. 7C is a top view of the same.

FIG. 7A shows a pedal mechanism assembly unit employing a preferred embodiment of the flywheel type resistance means. Therein the pedal assembly 19 comprises pedals and a hub to which the pedals are attached; and said resistance means 20 comprises a flywheel, a friction belt, and tension adjustment means. Said hub and flywheel are part of a conventional chain and sprocket or belt and pulley system 24, which is used to turn flywheel 25 around an axle fixed to assembly structure 18. A friction belt 26 in contact with said flywheel is tightened or loosened against the flywheel by any conventional tension adjustment means to produce variable resistance to rotational motion of the flywheel, and correspondingly to the pedals of the pedal assembly.

Optionally, an exercise data collection and display means, such as an exercise computer, may be attached. Said data collection and display means may be of any conventional type and can have inputs for collecting and/or measuring rotations per minute and resistance level from the pedaling assembly; calculation means to process said inputs to give outputs such as work done, simulated linear speed, and/or calories consumed; and means for displaying the collected, measured, and/or calculated data.

The pedal mechanism assembly unit is slidably and pivotally coupled to the assembly support of the structural frame unit such that a portion of said pedal mechanism assembly unit is positioned within the structural frame unit.

In a preferred embodiment as shown in FIGS. 1A–3C, the attachment means 21 is from the top dimension an elongated U shape, such that an opening 28 is sized to slidably accept the assembly support of the structural frame unit. The open end of the U shape of said attachment means is secured to assembly structure 18 by any appropriate means. The assembly support in this embodiment is a substantially vertical member 14 upon which the pedal mechanism assembly unit 12 may be slid and pivoted to various horizontal, vertical, and angled positions. Holes or stops are provided in said assembly support and the attachment means 21 so they may be secured together through securing means 17. Said securing means may be of any type known in the art which will, in a first state maintain the relative position of one or a set of holes or stops in said assembly support to one or a set of holes or stops in said attachment means, and in a second state allow the attachment means to move relative to the assembly support between sets of holes or stops in said assembly support. Preferred securing means utilize bolts or pins which may be spring mounted or be partially or completely removed and replaced to achieve the two states.

In an even more preferred embodiment as shown in FIGS. 5A–7C, the attachment means 21 of the pedal mechanism assembly unit 12 comprises two sleeve members, whose hollow portion is of constant inner dimension, one on each side of assembly structure 18. Said sleeve members are pivotally attached to said assembly structure such that each sleeve can be rotated with respect to said assembly structure while maintaining a constant distance. Said sleeves may be separately or jointly rotatable. In a most preferred embodiment, the axle around which flywheel 25 turns, extends through assembly structure 18 to provide a pin upon which attachment means 21 is pivotally attached. In this embodiment of the present invention, the assembly support of the structural frame unit consists of two substantially horizontal members 30, fixedly joined at the forward and backward ends by four substantially vertical members 14 of the rigid frame. Said horizontal members are sized to slidably fit within the hollow of the sleeves of attachment means 21 of the pedal mechanism assembly unit. Holes or stops are provided in the assembly structure 18 and the substantially vertical members 14 supporting the forward end of substantially horizontal supports 30. Securing means 17, through said holes or stops, secure 18 to 14. Said securing means useful in this embodiment are the same as those used in the previous embodiment, and preferably comprise pins or bolts.

The adjustable seat of the present invention comprises a substantially horizontal seating means, a back support means, and an arm rest support means, which can be adjusted to allow the user to be seated and supported at various positions in at least the forward and backward direction. These components of said adjustable seat, which are said seating means, back support means, and arm rest support means, may be individually or collectively adjusted utilizing any conventional arrangement. For example, all three, two, or none of said components may be attached together rigidly, pivotally, or hingedly.

In one embodiment of the present apparatus the adjustable seat comprises: a seating means 13 secured to the rigid frame; a back support means; and arm rest support means. Back support means 15 may be adjusted in a backward or forward direction. Arm rest support means 16 may be raised or lowered, being substantially T-shaped in the side dimension, such that the vertical portion of said arm rest means is respectively to a lesser or greater extent contained in a vertical sleeve of the rigid frame.

In other embodiments, seating means and back support means may be attached to each other, and may be together moved in a forward or backward direction. The arm rest support means here may be the same used in the embodiment above, or in the alternative be pivotally attached to the back support, in a conventional manner.

In all embodiments the adjustable seat moves to accommodate the range in size of intended users, as well as to compensate for different positions of the pedal mechanism assembly unit, but will stay fixed during the actual cycling exercise. Movement of the back support means, or of the back support means attached to the seating means, in a forward or backward direction with respect to the rigid frame is accomplished through any appropriate means and are preferably through: 1) guiding rails fixed to the rigid frame and glides or wheels fixed to a horizontal portion of the back support means or back support means/seating means, or 2) a pair of sleeves fixed to the rigid frame and a portion of the back support means or back support means/seating means comprising two horizontal members sized to slidably move within said sleeves; wherein said horizontal portion or members may be optionally hingedly attached to the rest of the back support means. Optionally, friction applying means such as a screw may be utilized through any sleeve supra which allows variation of the friction between said sleeve and the slidable member within the sleeve.

Figure 4A:
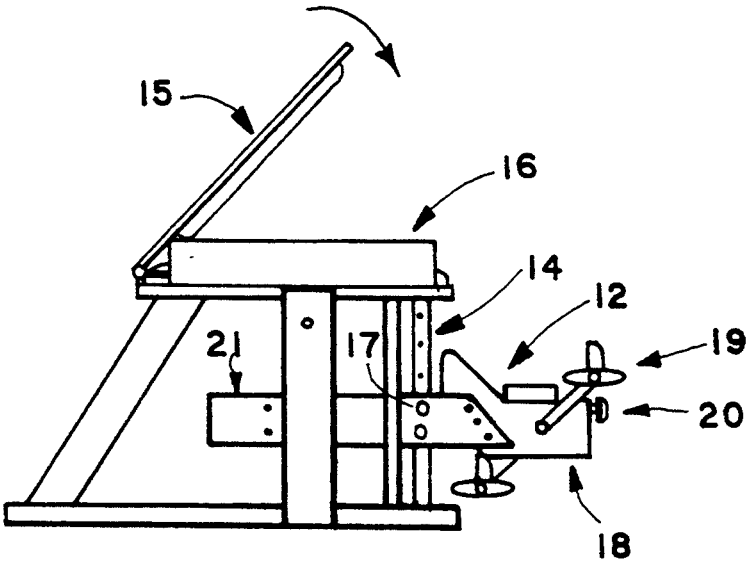
FIG. 4A is a side view which shows the collapsibility of one embodiment of the present apparatus.
Figure 8A:
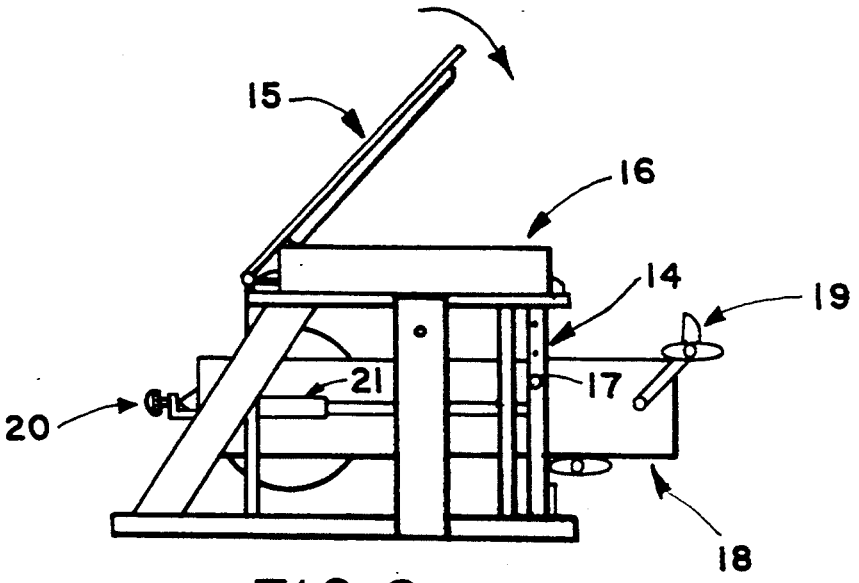
FIG. 8A is a side view which shows the collapsibility of one embodiment of the present apparatus.

As shown in FIGS. 4A and 8A, the present apparatus may be collapsed into a more compact form for storage purposes. Pedal mechanism assembly unit 12 may be slid under the adjustable seat, within the structural frame unit 11, to significantly reduce the overall length of the apparatus. In one embodiment, back support means 15 may be folded downward and arm rest support means 16 may be lowered, both of which will reduce the overall height of the apparatus. Alternatively, back support means 15 may be removed from contact with the rigid frame, inverted, and replaced.

Figure 4B:
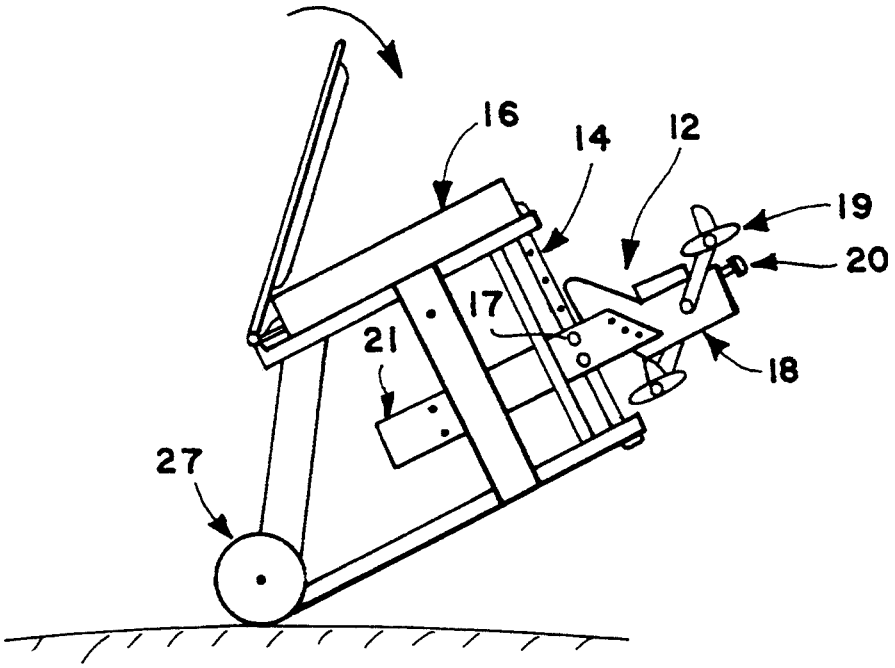
FIG. 4B is a side view which shows one embodiment of the present apparatus equipped with wheels.
Figure 5A:
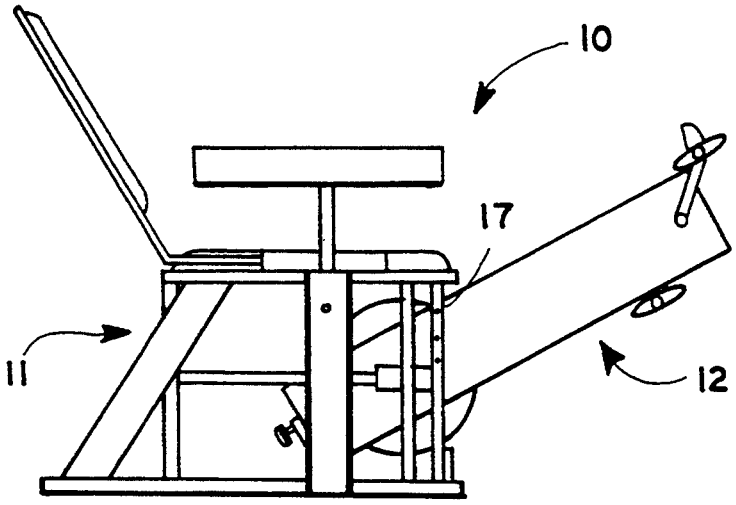
FIG. 5A, 5B, and 5C are side views showing another embodiment of the present apparatus.
Figure 5B:
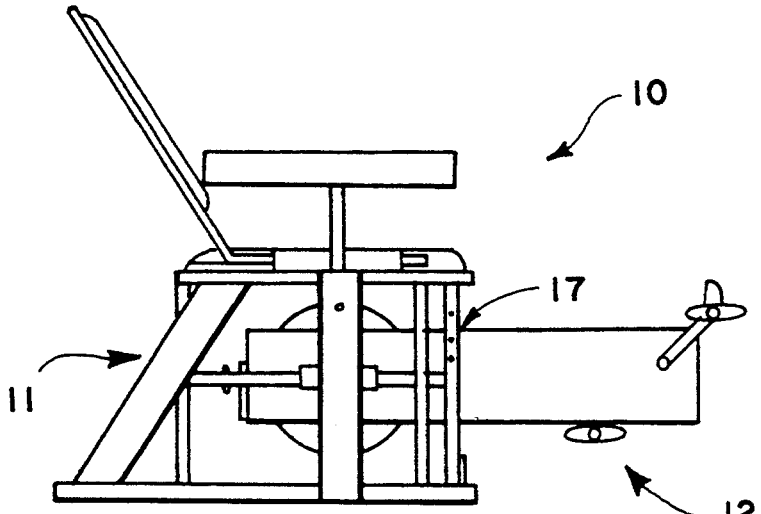
Figure 5C:
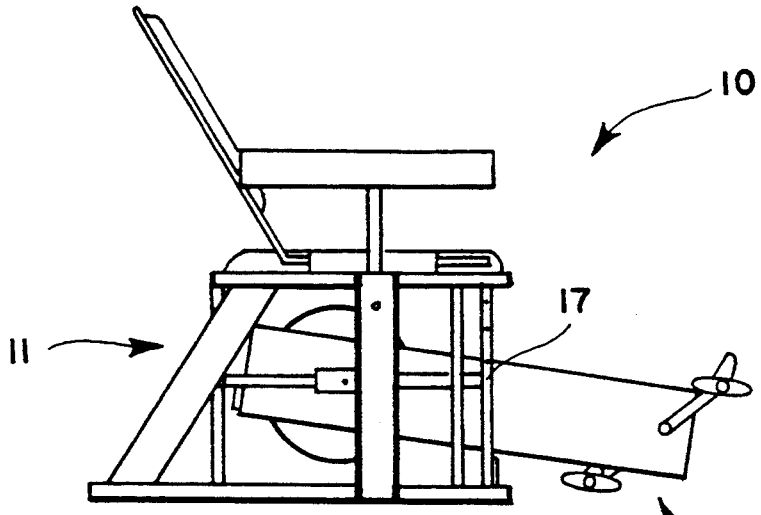
Figure 6A:
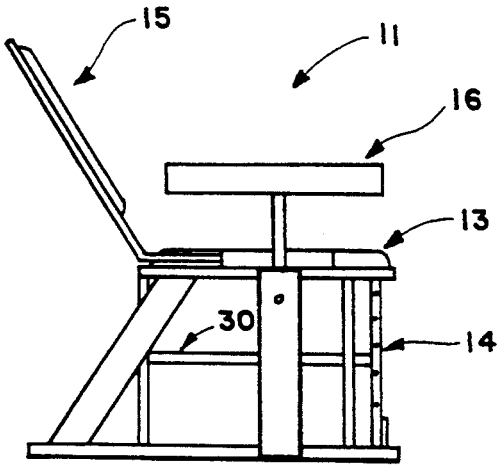
FIG. 6A is a side view of one embodiment of the structural frame unit of the apparatus shown in FIGS. 5A–5C.
Figure 6B:
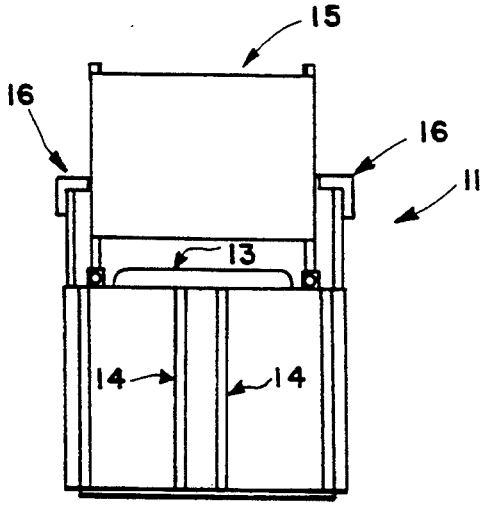
FIG. 6B is a front view of the same.
Figure 6C:
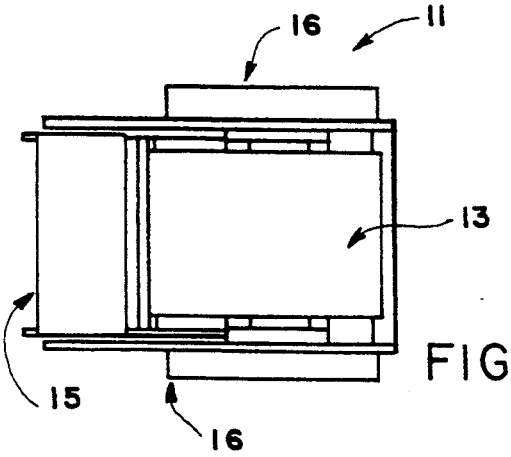
FIG. 6C is a top view of the same.
Figure 8B:
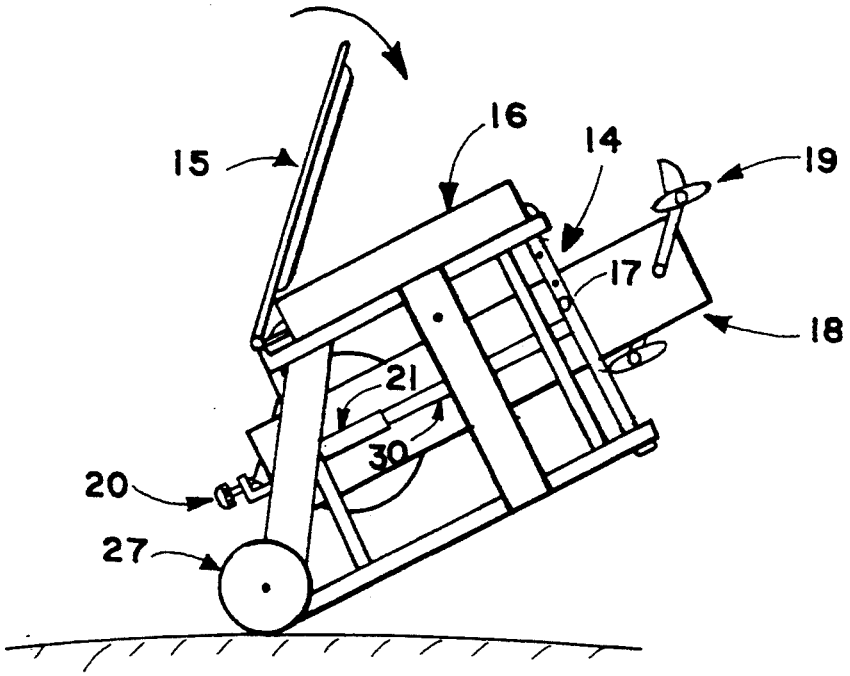
FIG. 8B is a side view which shows one embodiment of the present apparatus equipped with wheels.

Wheel assemblies may optionally be attached to the rigid frame of the structural unit in any appropriate manner to allow the present apparatus to be thereupon transported. These wheel assemblies are of any conventional type, and are either removable or have conventional means for locking the wheels such that, in one state, rotational motion of said wheels is substantially blocked, and in another, said wheels are free to rotate. Preferably at least two such wheel assemblies are attached to the lower portion of the rigid frame. FIGS. 4B and 8B show conventional wheel assemblies 27 attached to the rigid frame of the present apparatus.

It is to be understood that the present invention is not limited to the sole embodiment described above, but encompasses any and all embodiments within the scope of the following claims.

I claim:

1. An adjustable cycling apparatus which comprises;

a structural frame unit comprising a rigid frame, an adjustable seat mounted on said rigid frame, and an assembly support; and a pedal mechanism assembly unit having a pedal assembly and having an attachment means wherein said assembly unit is slidably and pivotally coupled to said assembly support of said structural frame unit such that the pedal assembly of said pedal mechanism assembly unit can be positioned at various horizontal, angled, and vertical levels, with at least a portion of said pedal mechanism assembly unit being positioned within said structural frame unit during normal operation of said apparatus;

whereby said apparatus may be used to participate in defined lower body exercise cycling routines while in a seated position.

2. The adjustable cycling apparatus as claimed in claim 1, wherein said adjustable seat comprises;

a horizontal seating means fixedly mounted on said rigid frame;

a back support means adjustably mounted on said rigid frame such that the back support may be moved in either a forward or backward direction with respect to said horizontal seat; and an arm rest support means.

3. The adjustable cycling apparatus as claimed in claim 1, which further comprises at least two wheel assemblies attached on at least one end of said structural frame unit.

4. An adjustable cycling apparatus as claimed in claim 2, wherein said back support means further comprises two hingedly attached horizontal members thereby allowing said back support means to be hingedly moved between a substantially vertical position to a more horizontal position with respect to the horizontal seat.

5. An adjustable cycling apparatus as claimed in claim 1, wherein the pedal mechanism assembly unit comprises:

an assembly structure;

resistance means;

wherein the pedal assembly comprises pedals connected to a hub; said hub and said resistance means are enclosed in the assembly structure; and said attachment means are on the exterior of the assembly structure;

whereby a user rotating said pedals rotates said hub against resistance from said resistance means.

6. An adjustable cycling apparatus as claimed in claim 5 wherein the resistance means further comprises a flywheel, a friction belt, and a chain and sprocket system, such that said flywheel is connected to said hub of said pedal assembly through said chain and sprocket system, whereby a user turning said pedals rotates said flywheel against said friction belt through said chain and sprocket system.

7. An adjustable cycling apparatus as claimed in claim 6 further comprising an axle fixed to said assembly structure, said axle passing through the center of said flywheel and said assembly structure, wherein:

said attachment means comprises two sleeve members, said sleeve members being pivotally attached to said assembly structure on said axle such that each sleeve member can be rotated, and said flywheel rotates around said axle.

8. An adjustable cycling apparatus as claimed in claim 7, wherein said assembly support of the structural frame unit comprises two substantially horizontal members and four substantially vertical members, wherein said horizontal members are fixedly joined at the forward and backward ends to said substantially vertical members and said horizontal members are sized to slidably fit within the hollow of said sleeve members of said attachment means of said pedal mechanism assembly unit.

9. An adjustable cycling apparatus as claimed in claim 1, wherein said apparatus is collapsible into a more compact configuration by lowering the overall height of said apparatus through said adjustable seat, and shortening the overall length of the apparatus by positioning said pedal mechanism assembly unit such that the majority of said pedal mechanism assembly unit is within said structural frame unit.

* * * * *